US005332006A

United States Patent [19]

Gaisser

[11] Patent Number: 5,332,006

[45] Date of Patent: Jul. 26, 1994

[54] CENTER CONNECTOR, FOR METALLIC WEAVING SHAFTS

[75] Inventor: Rudi Gaisser, Reutlingen, Fed. Rep. of Germany

[73] Assignee: Grob & Co Ltd., Horgen, Switzerland

[21] Appl. No.: 853,763

[22] PCT Filed: Dec. 21, 1990

[86] PCT No.: PCT/EP90/02273

§ 371 Date: Jun. 1, 1992

§ 102(e) Date: Jun. 1, 1992

[87] PCT Pub. No.: WO91/10764

PCT Pub. Date: Jul. 25, 1991

[30] Foreign Application Priority Data

Jan. 18, 1990 [DE] Fed. Rep. of Germany ..... 4001264

[51] Int. Cl.[5] ..... D03C 9/06

[52] U.S. Cl. ..... 139/91; 411/103; 403/346

[58] Field of Search ..... 411/103, 104, 105; 403/346, 388; 139/91; 52/426, 410, 729

[56] References Cited

U.S. PATENT DOCUMENTS

| | | | |
|---|---|---|---|
| 1,637,796 | 8/1927 | Andrews | 139/91 |
| 1,645,571 | 10/1927 | Andrews | 139/91 |
| 3,889,721 | 6/1975 | Wagner | 139/91 |
| 4,658,864 | 4/1987 | Goodman, Jr. | 139/91 |
| 5,082,031 | 6/1992 | Suhr | 139/91 |

FOREIGN PATENT DOCUMENTS

| | | |
|---|---|---|
| 0239013 | 9/1987 | European Pat. Off. . |
| 1265675 | 4/1968 | Fed. Rep. of Germany . |
| 371413 | 9/1963 | Switzerland . |

*Primary Examiner*—Andrew M. Falik
*Attorney, Agent, or Firm*—Michael J. Striker

[57] ABSTRACT

The weaving shaft and center connector, includes an upper shaft rod having an upper longitudinal side and a lower shaft rod; a round rod having a threaded lower end and an upper end guided through the upper shaft rod; a device for anchoring the threaded lower end of the round rod in the lower shaft rod; a stop collar connected with the upper longitudinal side of the upper shaft rod; a cap covering the upper end of the round rod and the stop collar and having through-holes on opposite sides of the connector rod; clamping screws extending through the through-holes of the cap for anchoring the cap on the upper shaft rod to secure the stop collar on the upper shaft rod; and a device for engaging a tool provided on the upper end of the round rod. The stop collar has a diameter corresponding at most to a thickness of the upper shaft rod.

6 Claims, 1 Drawing Sheet

CENTER CONNECTOR, FOR METALLIC WEAVING SHAFTS

BACKGROUND OF THE INVENTION

The invention is relates to a center connector, particularly for metallic weaving shafts. A center connector for a weaving shaft is known having a round rod whose lower end, which is provided with a thread, can be screwed on at the lower shaft rod up to a stop and which is guided through the upper shaft rod and can likewise be anchored at the upper longitudinal side of the upper shaft rod so as to be detachable.

A center connector having the aforementioned features for weaving shafts has already been used. However, it has the advantage that it is provided with a stop and fastening collar which can be connected directly with the upper shaft rod, the length of the stop and fastening collar being substantially greater than the thickness of the shaft rod. This results in the disadvantage that the center connector in a weaving shaft connection can no longer be detached because the fastening collar of the center connector rod would strike against adjacent weaving shafts when detaching. However, the use of warp thread draw-in machines requires that the center connector be detached when weaving shafts are inserted in the weaving machine.

SUMMARY OF THE INVENTION

It is an object of the invention to provide a center connector in such a way that it can easily be removed from the weaving shaft, even when the weaving shaft is arranged in a weaving shaft connection of a weaving machine, but without the spacing function of the center connector being impaired for this reason.

The proposed object is met according to the invention in a center connector of the above-described type in which the upper end of the center connector rod has means for engaging a screwdriver or socket wrench and has a stop collar which is rigidly connected with it and adjoins this engagement region, and in that the engagement region and the stop collar can be covered by a cap having recesses for these parts and through-holes at both sides of the center connector rod for clamping screws which can be anchored at the upper weaving shaft and ensure that the stop collar rests against the upper weaving shaft. It is advisable that the diameter of the stop collar be selected in such a way that it corresponds at most to the thickness of the upper shaft rod.

On the one hand, the cap enables the contact of the stop collar, which is important for a dimensionally accurate spacing of the upper weaving shaft from the lower weaving shaft. On the other hand, it prevents access to the upper end of the center connector rod. When the center connector rod is to be removed, the cap is first removed after loosening the clamping screws, then the center connector rod is unscrewed from the lower shaft rod at its exposed upper end and finally removed from above through the upper shaft rod. The clamping screws can be loosened and the center connector rod unscrewed either by a screwdriver directed from above against the narrow upper longitudinal side of the upper shaft rod or by a socket wrench which can likewise be applied from above, neither of which is impeded by adjacent weaving shafts. The reinsertion of the center connector rod is effected in the reverse order. The upper weaving shaft can advantageously be provided on its upper longitudinal side with a stop plate for the stop collar at the location where the center connector rod is guided through, which stop plate has a through-hole for the center connector rod and threaded through-holes for the clamping screws of the cover cap. Such a stop plate can ensure a more stable anchoring of the clamping screws e.g. than the wall of a shaft rod in the form of a light metal hollow-section rod.

The novel features which are considered as characteristic of the invention are set forth in particular in the appended claims. The invention itself, however, both as to its construction and its method of operation, together with additional objects and advantages thereof, will be best understood from the following detailed description of specific embodiments when read in connection with the accompanying drawings.

DETAILED DESCRIPTION OF THE PREFERRED EMBODIMENTS

Figure 2:
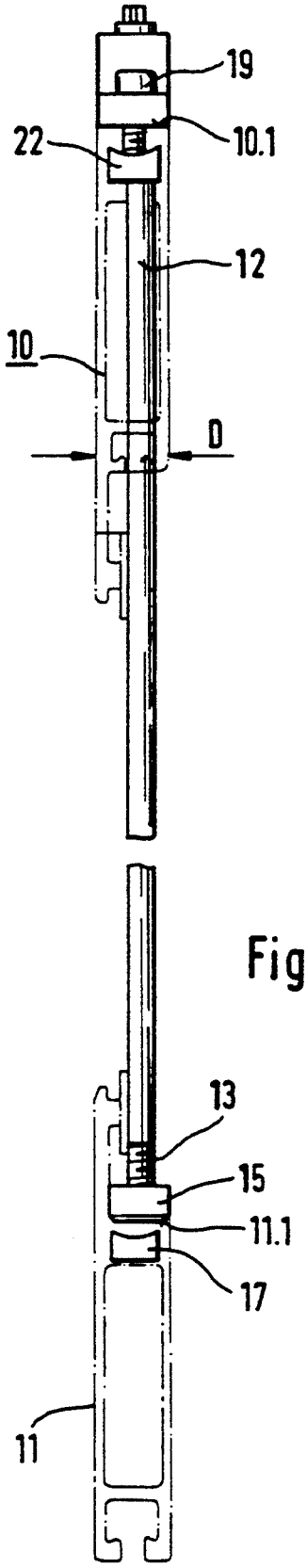
FIG. 2 shows a side view of the fitted center connector in the direction of arrow II in FIG. 1.

The drawing shows a light metal weaving shaft for heddles, not shown. The upper shaft rod 10 and the lower shaft rod 11 of the weaving shaft are constructed as hollow-chamber section rods whose cross section can be seen from FIG. 2. The center connector has a round rod 12 which is provided with an external thread 13 at its lower end. The fitted center connector rod 12 is screwed into an anchor plate 15 by this thread 13 until it rests against the longitudinal side 11.1 of the shaft, the anchor plate 15 being placed on an inner longitudinal side 11.1 of the lower shaft rod 11 and provided with a threaded through-hole 14. The anchor plate 15 is anchored by means of screws 16 in a crosspiece-like counter-holder 17 which is inserted into a longitudinal groove 11.2 of the lower shaft rod 11 having undercut edges.

Figure 1:
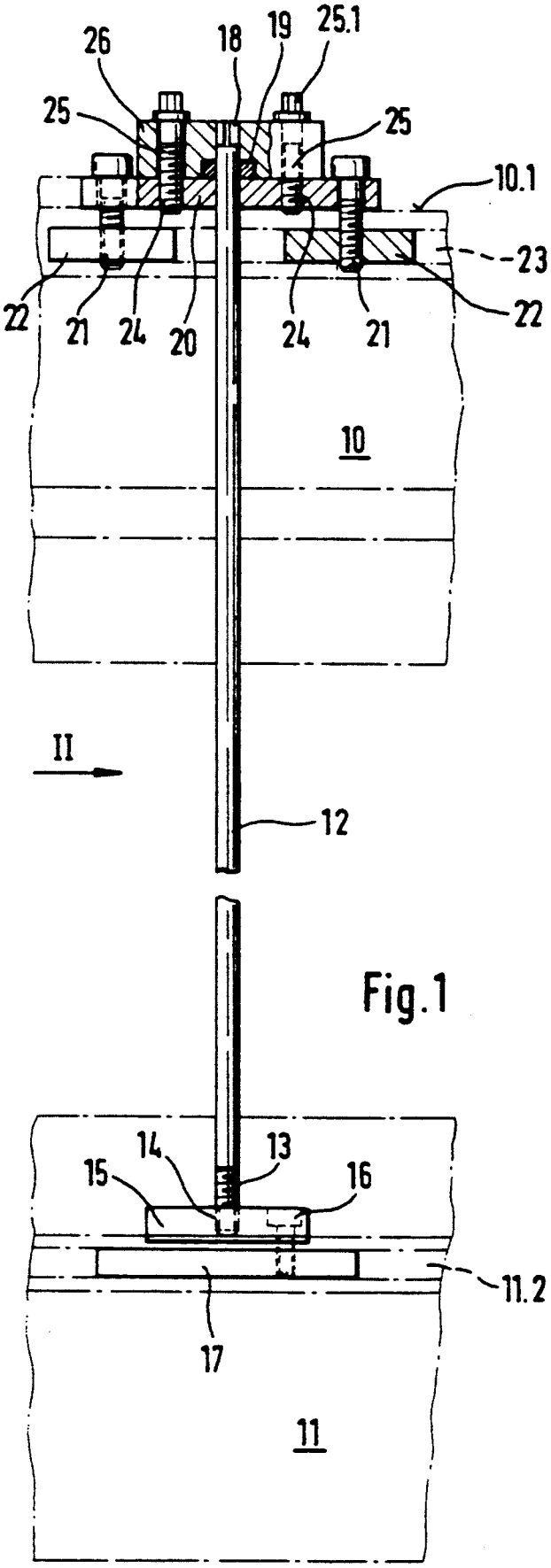
FIG. 1 shows a partial top view of a weaving shaft in the region of a center connector, with a longitudinal section through the upper fastening location for the center connector.

The center connector rod 12 is shaped at its upper end 18 to form a square for the application of a socket wrench. A stop collar 19 is fastened at a short distance from its upper end 18 at the center connector shaft 12, the diameter of the stop collar 19 being smaller than the thickness D of the upper shaft rod 10. The section walls of the upper shaft rod 10 are provided with through-holes, not designated in more detail in the drawing, which are aligned with one another and allow the center connector rod 12 to be guided through the upper shaft rod 10 as can be seen from FIG. 2. An elongated stop plate 20 is placed on the upper longitudinal side 10.1 of the upper shaft rod 10 and is anchored in abutment crosspieces 22 inserted into an upper longitudinal groove 23 of the upper shaft rod 10. The longitudinal groove 23 is provided with undercut edges. In addition to a central through-hole for the center connector rod, the stop plate 20 has two threaded through-holes 24 serving to anchor two head screws 25. The head screws 25 have a square head 25.1 for the application of a socket wrench and project through through-holes of a cover cap 26. The cover cap 26 likewise has a central through-hole for receiving the upper end 18 of the center connector rod 12. This through-hole is widened to form a recess in which the stop collar 19 of the center connector rod 12 fits, as can be seen from the sectional part of FIG. 1.

The upper end 18 of the center connector rod 12 covered by the cover cap 26 and secured against the application of a socket wrench. The cover cap 26 is drawn securely against the stop plate 20 by the head screws 25 so as to ensure a tight contact of the stop collar 19 against the stop plate 20 and accordingly also a more exactly predetermined mutual distance of the two shaft rods 10 and 11. The center connector rod 12 is screwed into the anchor plate 15 by its lower threaded end 13 until stopping against the lower shaft rod 11.

If the center connector rod 12 is to be removed for setting up a warp thread draw-in machine, the two head screws 25 are first loosened and the cover cap 26 is then lifted. A socket wrench can then be applied to the upper end 18 of the center connector rod 12 and the center connector rod 12 can be unscrewed from the anchor plate 15 by its lower threaded end 13 and then removed upward through the upper shaft rod 10. The reinsertion of the center connector rod 12 is effected in the reverse sequence.

While the invention has been illustrated and described as embodied in a center connector, in particular for metallic weaving shafts, it is not intended to be limited to the details shown, since various modifications and structural changes may be made without departing in any way from the spirit of the present invention.

Without further analysis, the foregoing will so fully reveal the gist of the present invention, that others can, by applying current knowledge, readily adapt it for various applications without omitting features that, from the standpoint of the prior art, fairly constitute essential characteristics of the generic or specific aspects of this invention.

I claim:

1. Weaving shaft and center connector, comprising an upper shaft rod having an upper longitudinal side and a lower shaft rod; a round rod having a threaded lower end and an upper end guided through said upper shaft rod; means for anchoring said threaded lower end of said round rod in said lower shaft rod; a stop collar connected with said upper longitudinal side of said upper shaft rod; a cap covering said upper end of said round rod and said stop collar and having through-holes on opposite sides of said round rod; clamping screws extending through said through-holes of said cap for anchoring said cap on said upper shaft rod to secure said stop collar on said upper shaft rod; means for engaging a tool provided on said upper end of said round rod, wherein said stop collar has a diameter corresponding at most to a thickness of said upper shaft rod.

2. Weaving shaft and center connector as defined in claim 1, wherein said cap is provided with recesses to accommodate said round rod and said stop collar.

3. Weaving shaft and center connector as defined in 1, wherein said means for engaging a tool is formed so said upper end can be engaged by a socket wrench.

4. Weaving shaft and center connector as defined in claim 1, further comprising a stop plate secured to said upper longitudinal side of said upper shaft rod on which said stop collar contacts under said cap, said stop plate being provided with a throughgoing hole for said round rod and threaded throughgoing holes for said clamping screws, and means for securing said stop plate to said upper longitudinal side.

5. Weaving shaft and center connector as defined in claim 5, wherein said upper shaft rod is provided with a longitudinal groove having undercut edges and said means for securing said stop plate to said upper longitudinal side includes two abutment crosspieces inserted in said longitudinal groove and each provided with a throughgoing threaded passage, and additional throughgoing holes in said stop plate on opposite sides of said throughgoing hole for said round rod, and threaded anchoring bolts passing through said additional throughgoing holes and engaged in said threaded passages of said abutment crosspieces.

6. Weaving shaft and center connector as defined in claim 5, wherein said lower shaft rod is provided with a longitudinal groove and wherein said means for anchoring said threaded lower end includes an anchor plate having a threaded throughgoing passage in which said threaded lower end of said round rod is screwed, a crosspiece-like counter holder inserted in said longitudinal groove of said lower shaft rod and a threaded bolt securing said anchor plate to said lower shaft rod engaged in said crosspiece-like counter holder.

* * * * *